United States Patent [19]

Everman

[11] Patent Number: 4,495,032

[45] Date of Patent: Jan. 22, 1985

[54] SPLIT HUB WHEEL APPARATUS

[76] Inventor: Carl G. Everman, P.O. Box 204, Grayson, Ky. 41143

[21] Appl. No.: 542,834

[22] Filed: Oct. 17, 1983

Related U.S. Application Data

[62] Division of Ser. No. 255,126, Apr. 17, 1981, Pat. No. 4,410,416.

[51] Int. Cl.[3] ..... C10B 1/00; C10B 47/00

[52] U.S. Cl. ..... 202/105; 196/14.52; 201/10; 202/99; 202/136; 202/218; 202/219; 202/262; 208/11 LE; 208/8 LE; 414/290; 414/301; 422/233; 422/271; 422/273; 422/277

[58] Field of Search ..... 208/8 R, 11 R, 11 LE, 208/8 LE; 422/232, 233, 273, 271, 275, 277; 201/11, 10; 202/99, 219, 262, 208, 105, 218; 414/150, 158, 172, 208, 216, 586, 290, 301; 196/14.52

[56] References Cited

U.S. PATENT DOCUMENTS

| | | | |
|---|---|---|---|
| 14,548 | 11/1918 | Lummis | 202/262 |
| 1,342,790 | 6/1920 | Bergius | 208/8 LE |
| 1,556,571 | 10/1925 | Dobbelstein et al. | 202/136 |
| 1,601,222 | 9/1926 | Naugle | 202/136 |
| 1,765,702 | 6/1930 | Roser | 202/136 |

*Primary Examiner*—Jay H. Woo
*Assistant Examiner*—Mike McGurk
*Attorney, Agent, or Firm*—Panitch Schwarze Jacobs & Nadel

[57] ABSTRACT

A shale oil retort apparatus is provided for retorting oil shale under airtight conditions. The retort apparatus employs a split hub wheel device which allows for the axial feeding of crushed oil shale and the axial dispensing of spent oil shale. The retort apparatus utilizes a rotatable shaft on a stationary axle, said shaft containing three spokes that are set approximately equidistant apart. The spokes serve to feed raw oil shale, dip it into a hot oil bath and dispense spent oil shale out of the apparatus.

5 Claims, 4 Drawing Figures

SPLIT HUB WHEEL APPARATUS

CROSS REFERENCE TO RELATED APPLICATION

This application is a division of copending U.S. patent application Ser. No. 255,126, filed Apr. 17, 1981, now U.S. Pat. No. 4,410,416, issued Oct. 18, 1983.

DISCLOSURE DOCUMENT

The subject of the present application was described in a Disclosure Document filed Jan. 28, 1980 by the applicant, No. 087676.

BACKGROUND OF THE INVENTION

The present invention relates to a split hub wheel apparatus for sequential loading, dipping and unloading of material while selectively sealing the apparatus in an air tight environment. More particularly, this invention pertains to the use of a split hub wheel apparatus for the production of high quality fuel oil and motor fuel from oil shale.

Up until the early 1970's liquid hydrocarbon fuels were plentiful and relatively inexpensive. Such fuels were generally derived from crude petroleum found in the Middle East, Far East, United States, Canada, South America and Africa. The onset of the Arab oil embargo of 1973 and the constant turmoil that has persisted in that area since then has served to sharply decrease world oil supplies and concomitantly quadruple energy costs. Furthermore, the energy picture for the future appears to be very grim with the prediction of higher fuel prices and shortages. Aggravating the world energy situation is the continuing increased consumption of petroleum and petroleum based products such as plastics. With each passing year, the dependence of the world on high priced OPEC oil increases beyond all reasonable bounds. Accordingly, great attention has recently been focused on developing alternate energy sources.

Oil shale is America's most abundant energy resource–even bigger than coal. An estimated 28 trillion barrels of oil are locked in shale deposits in at least 13 states, enough to supply the United States with vital liquid hydrocarbon fuel for hundreds of years.

The Green River Formation covering about 17,000 square miles in parts of Colorado, Utah and Wyoming represent about 2½ times all the oil reserves in the Western world and the Mideast combined. Furthermore, energy experts predict by the year 1990 the shale oil industry will represent a multi-billion-dollar business capable of producing well over 500,000 barrels of oil per day.

Oil shale is neither an oil nor a shale. The term "oil shale" refers to a carbonaceous rock, i.e. marl–a type of limestone, that contains a high molecular weight organic polymer called kerogen. Kerogen is the oil precursor in the oil shale rock. To extract the kerogen from the oil shale, the oil shale must generally be broken into small pieces and heated to pyrolysis temperatures in the range of between about 800° F. (420° C.) and about 1000° F. (538° C.). Oil cannot be derived from oil shale deposits by solely using solvents. The heating of the oil shale and the subsequent production of kerogen is generally carried out in large ovens called retorts or while the oil shale is still underground (in-situ).

Retorting of the oil shale at pyrolysis temperatures causes decomposition of the kerogen and evolution of the oil trapped in the ore, usually in the form of a condensable vapor. If the kerogen is evolved as a vapor, it is condensed to form a thick, viscous black liquid. In this state, the shale oil liquid can generally be used directly for oil or fuel, i.e. as fuel oil. Before it can be refined into more valuable products, the shale oil liquid must generally be treated with hydrogen, i.e. hydrotreating, to remove excess nitrogen and arsenic. Once upgraded, however, the refined products of shale oil are generally superior to those obtainable from the best Saudi Arabian crude oil.

The art of oil shale retorting traces its origins back to as early as 1694 when a patent issued in England to distill oil "from a kind of stone". In the mid 1850's, oil shale was being produced in France, Scotland, Australia, as well as in the United States. More than 3,000 foreign and domestic patents on shale oil retorting processes and associated equipment have since issued.

The major shale oil retorting processes are Paraho, Superior Circular Grate, Union, Tosco II, Lurgi-Ruhrgas and N-T-U. The Paraho, Union and N-T-U processes all involve vertical retorts utilizing hot gas as the heating medium. The Superior Circular Grate and the Tosco II processes use horizontal retorts. The Tosco II process employs a rotating drum with hot ceramic balls supplying the necessary heat. The Lurgi-Ruhrgas process uses a screw mixer and relies on spent shale for process heating.

A lesser known shale oil retorting process, but one employing an air tight kettle of hot liquid and agitation by revolving arms is the Ryan process. The Ryan process, however, suffers from serious drawbacks in that it is subject to explosions and requires a residence time that is considerably longer than the residence time required by the present invention.

The use of rotating retort drums to conduct shale oil processing and oil distillation is well known in the art and is described by many patents, including the following U.S. Pat. Nos. 356,247; 552,456; 634,818; 635,260; 1,183,457; 1,508,578; 1,656,107; 1,695,914; 1,870,901; 1,905,055; 4,105,536 and 4,125,437. These patents concern rotating drums, rather than rotating arms as utilized in in the present invention.

The use of rotating arms to supply agitation during retorting is described in U.S. Pat. Nos. 1,323,681; 1,598,882; 1,614,220; 1,638,217 and 1,681,946. The arms in these patents, however, are used to agitate the retort fluid rather than to unload and dip the shale ore feed and unload the spent oil shale.

U.S. Pat. Nos. 3,443,793; 3,558,100 and 3,612,102 disclose rotary valves having stationary inlet and outlet pipes, disposed at an angle to the axis of rotation of a flow chamber. These patents, however, do not describe the loading, dipping and unloading of material.

U.S. Pat. Nos. 1,461,396 and 2,588,483 describe rotating feeding and dispensing of materials. In both patents, material from a stationary inlet is dropped into a chamber or pocket of a rotating drum. The drum rotates and the material is dispensed by gravity when the pocket or chamber comes into contact with the stationary outlet.

French Pat. No. 13,426 illustrates axial feeding and dispensing using a rotary flow chamber.

U.S. Pat. No. 1,513,504 concerns a centrifugal device. This patent discloses a drum having a rotating shaft. The shaft is partially hollow and serves to both feed and discharge liquids from the drum. Connected to the rotating shaft is a hollow perforated ring. This patent doesn't describe the dipping of fed materials in a liquid bath.

SUMMARY OF THE INVENTION

There has now been discovered a loading, dipping and unloading apparatus and the use of same in shale oil retort processing. The apparatus allows for the sequential loading, dipping and unloading of material in an air tight environment which comprises a housing, a stationary hollow cylindrical axle positioned in the housing and having a top and bottom opening. An inlet and outlet conduit are connected to the axle. The inlet conduit is disposed at an acute angle with its outer open end communicating with the environment external to the housing and its inner open end communicating with the bottom opening in the axle. The outlet conduit is disposed at an obtuse angle with its outer open end communicating with the environment external to the housing and its inner open end communicating with the top opening in the axle. Snugly fit around said axle is a rotatable cylindrical hollow shaft. The shaft has three hollow, perforated spokes set approximately equidistant apart from each other. The spokes are closed at their outer ends and open at their inner ends which contact the shaft. A liquid bath is maintained within the housing such that all the spokes are capable of contacting the liquid bath during one complete rotation of the shaft. Means are provided to rotate the shaft around the axle. This rotation allows for the successive alignment of the open ends of the spokes and the openings in the axle such that the material is sequentially loaded in one spoke at a time, dipped in the liquid bath while contained in the spoke and unloaded from the spoke. The loading, dipping and unloading occur while the housing is maintained at air tight conditions.

The apparatus of the present invention is an open pipe with a divider permitting loading from a stationary supply conduit on the axle (axial feeding). Rotation of the shaft serves to unload material in one shaft at a time. Further rotation carries the material filled spoke through the liquid bath. After a desired residence time for dipping of the material in the liquid bath, the material is carried up and out of the bath and discharged through a stationary conduit at the other end of the axle (axial dispensing).

The above described sequence for one spoke is exactly the same as for the other two spokes. Loading and unloading do not occur simultaneously so as to insure air tight operation. For example, while one spoke is being loaded, another spoke is being dipped into the liquid bath, while the third spoke is out of the bath and draining.

The only moving part of the apparatus of the present invention is the shaft carrying the hollow spokes. The shaft can be driven by any convenient means, such as by a motor. To maintain the housing of this apparatus in an air tight condition, both the inlet and outlet conduits are sealed from the outside environment. The liquid bath can be heated and maintained at desired temperatures by heating the housing.

The present invention also concerns a process for the production of liquid shale oil and other products from solid oil shale comprising subdividing solid oil shale to a suitable size and then dipping the subdivided solid oil shale under air tight conditions into a liquid bath for a period of time between about 0.5 minutes and about 3.5 minutes. The liquid bath is maintained at a temperature of between about 500° F. and about 1000° F. Vapors evolved during the dipping are collected and condensed.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
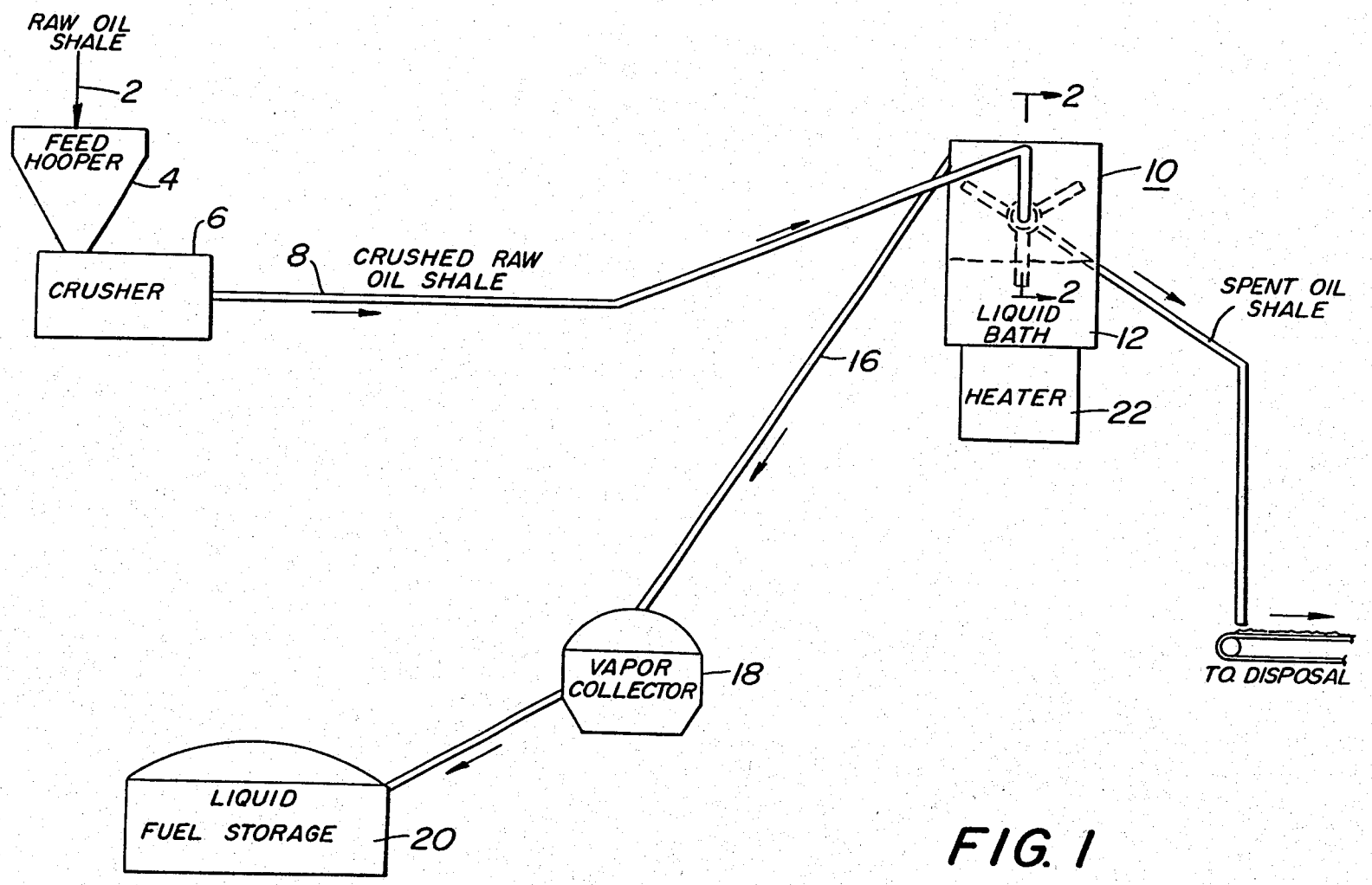
FIG. 1 is a schematic flow diagram of a shale oil retort process utilizing the novel sequential loading, dipping and unloading apparatus of the present invention.

Referring in detail to the drawings, in all of which like parts are designated by like reference numerals, FIG. 1 shows diagrammatically the use of the novel apparatus of this invention in an integrated shale oil retorting process, presented for convenience of reference in the form of a process flow diagram.

Raw oil shale 2 is fed into a feed hopper 4 for direction into a crusher 6. In the crusher 6, the oil shale is subdivided into a suitable size such as between about 0.0125 inch and one inch, preferably between about 0.25 inch and one-half inch. The crushed raw shale 8 is then through conduit 9 to a split hub wheel retort 10 which acts to sequentially load the raw shale, dip it into a liquid bath 12 and unload the spent oil shale 14 while maintaining an air tight retort. The spent oil shale 14 (oil shale that has been retorted) is directed to disposal facilities.

The liquid bath 12 is maintained at a temperature of between about 500° F. and 1000° F., preferably between about 680° F. and 700° F. The oil shale remains dipped in the liquid bath 12 for a period of time between about 0.5 minute and 3.5 minutes, preferably between about 1.0 minute and 2.5 minutes. During the dipping of the oil shale in the liquid bath, vapor is evolved. This shale oil containing vapor exists via a conduit 16 and enters a vapor collector 18 and is then directed to liquid fuel storage 20. The vapor collector 18 serves as a holdup in the vapor conduit to allow the vapor to condense. If the processing is conducted in cool climates the vapor will condense without the need for external cooling equipment. Alternatively, if the processing is conducted in warm climates, the conduit and/or vapor collector will have to be cooled to condense the vapor.

The liquid bath 12 consists of any liquid which will not boil at the processing temperatures useful herein, i.e. as high as 1000° F. Liquids thus suitable for this invention include heavy oils such as gear grease and oil derived from oil shale.

The liquid bath 12 is maintained at the above mentioned temperatures by use of a heater 22. The heater 22 can be any convenient heating means such as a furnace or electric heater. The furnace can be fueled by coal, solid oil shale, liquid shale oil derived from the process of this invention, natural gas, bottled gas, fuel oil or any other fuel. If, for example, a coal-fired boiler is employed, auxiliary equipment must be supplied such as an air blower and a flue gas scrubbing system. The split hub wheel retort apparatus (loading, dipping and unloading apparatus) is shown in greater detail in FIGS. 2–4.

The crushed raw oil shale 8 enters the split hub wheel retort 10 into a loading, dipping and unloading device 22 located within the air tight environment of the split hub wheel retort 10. The crushed raw oil shale 8 is fed via an auger feeder 26 into an inlet conduit 28. The auger feeder 26 is preferably motor driven. The auger feeder is disposed within the inlet conduit 28, upstream of the opening 34 at the bottom of a stationary hollow axle 30. The auger feeder 26 is sealed so as to prevent air from entering the split hub wheel retort 10.

The inlet conduit 28 is disposed at an acute angle, preferably at an angle of between about 30° and about 45° and is attached to the stationary hollow cylindrical axle 30. Also attached to the stationary hollow cylindrical axle 30 is an outlet conduit 32. The outlet conduit 32 is disposed at an obtuse angle, preferably between about 135° and about 150°. The stationary hollow cylindrical axle 30 has an opening at the bottom 34 and the top 36. The inlet conduit 28 communicates with the bottom opening in the axle 34; the outlet conduit 32 communicates with the top opening in the axle 36. A rotatable hollow cylindrical shaft 38 snugly fits around the stationary axle 30. The shaft 38 is connected to a drive wheel 42 which is driven by any convenient means, such as a motor. The shaft 38 has three perforated hollow spokes 40 set approximately equidistant apart from each other. The spokes 40 are closed at their outer ends and open at their inner ends which connect to the shaft 38.

The level of the liquid bath 12 is maintained in the split hub wheel retort 10 by any convenient means, such as by a level control (not shown). The liquid bath 12 is maintained at such a level such that during one full rotation of the shaft 38 all three spokes 40 come in contact with the liquid bath 12.

Figure 2:
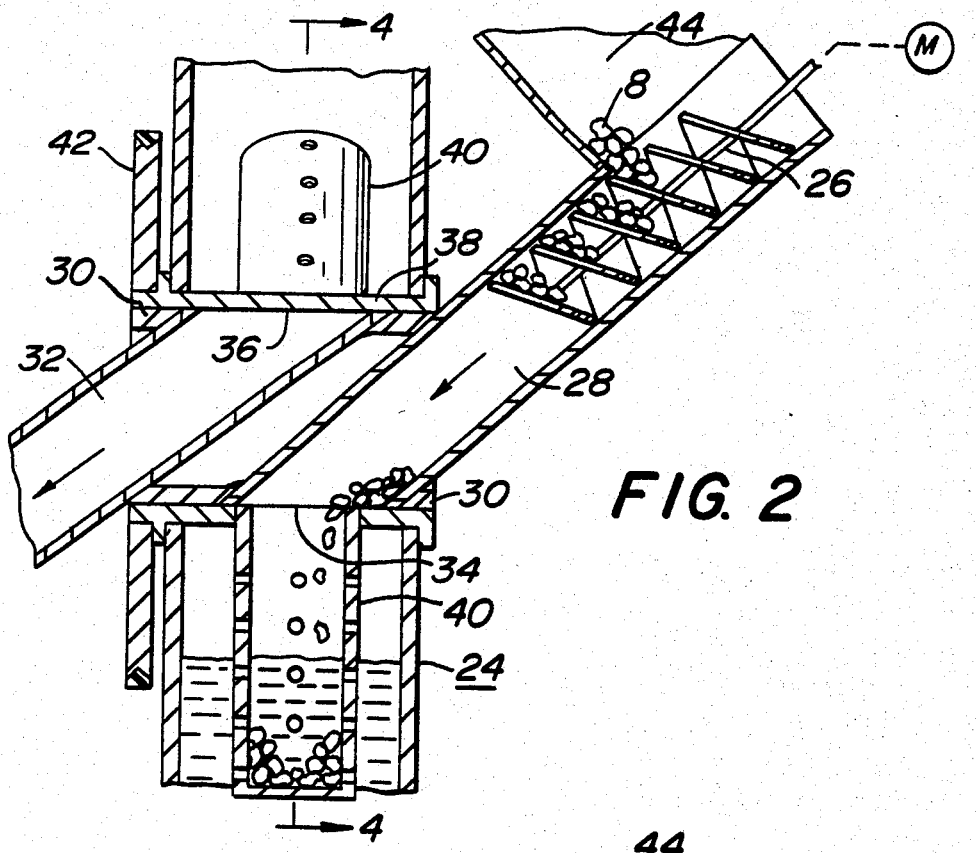
FIG. 2 shows a sectional view of the sequential loading, dipping and unloading apparatus of this invention taken along line 2—2 of FIG. 1. In this figure, one of the spokes of the shaft is shown aligned with the inlet conduit such that the feeding of materials is illustrated.

The feeding of crushed raw shale 8 into the split hub wheel retort 10 is shown in detail in FIG. 2. Crushed raw shale 8 is directed to inlet chamber 44. Crushed raw shale 8 is fed into inlet conduit 28 by auger feeder 26. When any one of the inner ends of the three spokes 40 aligns with the bottom opening in the axle 34 which communicates with the inlet conduit 28, the crushed raw shale 8 then proceeds to fall into that hollow spoke 40 by gravity.

Figure 3:
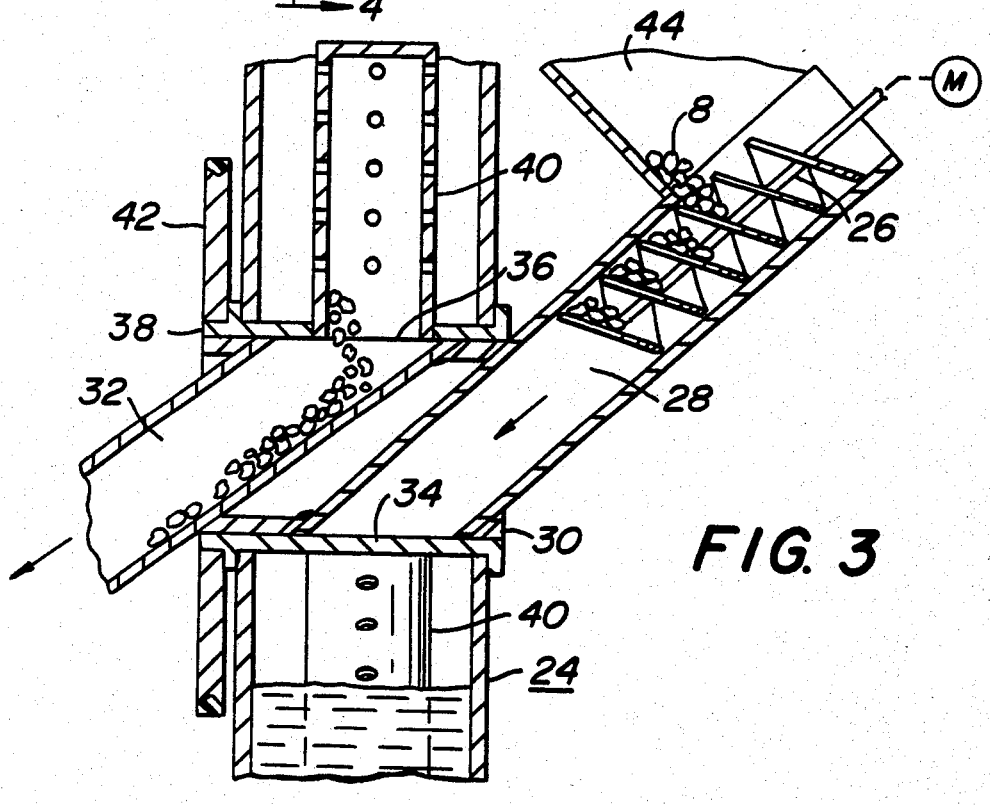
FIG. 3 also shows a sectional view of the sequential loading, dipping and unloading apparatus of the present invention taken along line 2—2 of FIG. 1. This figure illustrates the positioning of one of the spokes with the outlet conduit such as to show the unloading of materials.
Figure 4:
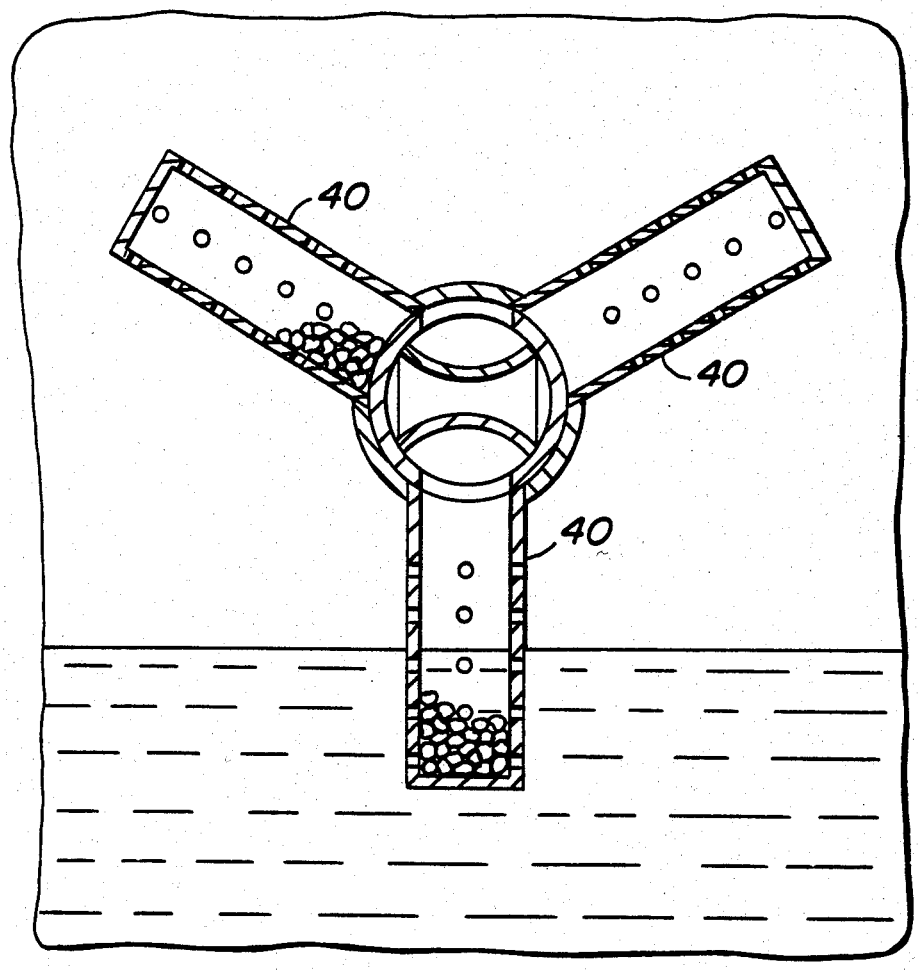
FIG. 4 shows a sectional view of the apparatus of the present invention taken along lines 4—4 of FIG. 2. In this view, the three spokes of the apparatus are clearly shown.

The unloading of spent oil shale 14 is depicted in greater detail in FIG. 3. As the shaft 38 rotates, the bottom opening in the axle 34 is closed to prevent further loading of the crushed raw shale 8. Further rotation of the shaft 38 causes the spoke 40 carrying the crushed raw shale 8 to dip into the liquid bath 12. After approximately two minutes of dipping, the rotation of shaft 38 results in the spoke 40, which is carrying the oil shale to exit the liquid bath 12 and drain for approximately two minutes. Further rotation of shaft 38 causes the spoke 40 to align with the top opening 36 in the axle 30. This alignment causes the spent oil shale 14 to flow by gravity through outlet conduit 32. Valve means (not shown) is provided on the outlet conduit 32 to insure air tight conditions within the split hub wheel retort 10. The valve means closes the outlet conduit 32 during unloading of spent oil shale 14 and opens when the top opening 36 in the axle 30 aligns with outlet conduit 32.

Retorting occurs during the period when the crushed raw shale 8 is dipped into the hot liquid bath 12. The contact of the crushed raw shale 8 and the hot liquid bath 12 causes shale oil containing vapor to evolve from the crushed raw shale 8. After evolution of the shale oil containing vapor, the solid oil shale is converted into spent solid oil shale in which the shale oil has been extracted from it, i.e. retorted oil shale.

The present invention affords an advantage over other processes in that valuable metals contained in the crushed raw shale 8 are not evolved in the shale oil containing vapor, but remain in the spent oil shale 14. This results in less processing required for the liquid shale oil product and easier recovery of valuable metals such as zinc, gold, silver, uranium, etc.

The split hub wheel retort 10 is maintained under air tight conditions to avoid the possibility of explosions. If air were to come into contact with a hot oil used in the liquid bath 12, an explosion would necessarily result.

The apparatus of the present invention is not limited to use as a shale retort. It can be employed any time the sequential loading, dipping, draining and unloading of materials is required. Non-limiting uses of this apparatus are the dye dipping of fabrics and the coating of metals. The apparatus of this invention is particularly useful when it is required that such dipping occur in air tight conditions.

A pilot plant embodying the concept of this invention was employed to generate liquid shale oil, i.e. produce oil from solid raw oil shale. The liquid oil bath, i.e. process oil, consisted of gear oil. Analyses of the process oil and product oil obtained are given hereinbelow in Table 1.

The pilot plant unit was constructed according to the present invention using ¼" steel plate. The internal hub assembly was constructed from machined tooled steel.

The size of the pilot plant unit oil bath was approximately 6 inches wide by 36 inches high by 48 inches long. The oil bath was heated to about 750° F. by an induced air coal-fired furnace situated right below the bath. The furnace dimensions were 50 inches long by 24 inches wide by 24 inches high.

Devonian shale was fed into the pilot plant unit at a rate of 4 pounds per batch. The unit was maintained at essentially atmospheric pressure and the residence time of the shale in the hot oil bath was approximately 3 minutes, 40 seconds.

TABLE 1

GROSS OIL & DETAILED $C_{15+}$ OIL COMPOSITION

| | PROCESS OIL (GEAR GREASE) | PRODUCT OIL (SHALE OIL) | ADJUSTED* VALUES FOR PRODUCT OIL |
|---|---|---|---|
| GROSS OIL COMPOSITION | | | |
| $<C_{15+}$ | 1.6% | 62.5% | 71.8% |
| $>C_{15+}$ | 98.4% | 37.5% | 28.2% |
| API GRAVITY | — | 40–50 | — |
| DETAILED $C_{15+}$ COMPOSITION | | | |

TABLE 1-continued

GROSS OIL & DETAILED $C_{15+}$ OIL COMPOSITION

| | PROCESS OIL (GEAR GREASE) | PRODUCT OIL (SHALE OIL) | ADJUSTED* VALUES FOR PRODUCT OIL |
|---|---|---|---|
| Asphaltene | 1.97% | 3.97% | 5.28% |
| Paraffin-Naphthene | 54.14% | 46.72% | 62.15% |
| Aromatic | 32.11% | 15.55% | 20.69% |
| Eluted NSO** | 8.51% | 6.14% | 8.17% |
| Non-eluted NSO** | 3.27% | 27.62% | 3.71% |

*The adjusted values reflect changes made in the weight data to account for the incomplete $C_{15+}$ pentane soluble portion following deasphalting. The topping of solvent from the separated chromatographic fractions is much more complete and the high non-eluted NSO fraction is clearly erroneous since the chromatographic column is completely clean following elution.
**NSO = nitrogen-sulfur-oxygen The product oil was found to be miscible and contained no water. Much of the product oil was found to be in the valuable liquid hydrocarbon range, i.e. ($C_4$–$C_7$) gasoline-range, ($C_8$–$C_{14}$) kerosene and ($C_{15}$–$C_{23}$) diesel fuel. The product oil could be utilized directly as a diesel fuel or crude gasoline fuel without further processing. Utilizing this invention thus produced a valuable liquid hydrocarbon fuel that did not require further expensive treatment, i.e. hydrotreating.

Infrared spectroscopy and gas chromatography indicated that the product oil was of high quality, having lesser amounts of phenols and amines (undesirable polar constituents) normally found in oils from steam retorting of shale. The product oil was primarily straight-chain hydrocarbons (40%), both linear alkanes and normal 1-alkenes. It was much like a naphtha derived from Western (Green River) oil shale.

Table 2, given hereinbelow, shows the results for a simulated distillation performed on the product oil and process oil.

From these results, the product oil was found to be 61–64% naphtha (less than 450° F.), 33–35% light fuel oil (450°–650° F.) and only % heavy fuel oil (greater than 650° F.) with no residuum. The product was much richer in naphtha than oil derived from stream retorting of shale.

Pyrolysis of the bath oil at 680°–700° F. yielded 3% of a pyrolysate/distillate which was unlike the product oil. Provided that the shale does not catalyze by alternative modes of bath oil decomposition, it is estimated that less than 20% bath oil was converted to product oil.

The present invention may be embodied in other specific forms without departing from the spirit or essential attributes thereof and, accordingly, reference should be made to the appended claims, rather than to the foregoing specification, as indicating the scope of the invention.

TABLE 2

| | Simulated Distillation Percent Distilled | | | | | | |
|---|---|---|---|---|---|---|---|
| | 1% | 10% | 20% | 40% | 60% | 80% | 90% |
| Product Oil | 225° F. | 287° F. | 325° F. | 385° F. | 441° F. | 520° F. | 582° F. |
| Process Oil - Grease | 519° F. | 730° F. | 847° F. | 994° F. | 1097° F. | | |

I claim:

1. An apparatus for the sequential loading and unloading of material in an air tight environment which comprises:
   (a) a housing;
   (b) a stationary hollow cylindrical axle having a top and bottom opening, said axle positioned within said housing;
   (c) an inlet conduit disposed at an acute angle with respect to that portion of a vertical plane passing through said housing and above said axle, and said conduit having its outer open end communicating with the environment external to said housing and its inner open end communicating with said bottom opening in said axle;
   (d) an outlet conduit disposed at an obtuse angle with respect to that portion of said vertical plane passing through said housing and above said axle, and said conduit having its outer open end communicating with the environment external to said housing and its inner open end communicating with said top opening in said axle;
   (e) a rotatable cylindrical hollow shaft snugly fit around said axle, said shaft comprising three hollow, perforated spokes set approximately equidistant apart from each other and extending radially outward from said shaft, said spokes being closed at their outer ends and open at their inner ends contacting said shaft;
   (f) a liquid bath maintained within said housing such that all three of said spokes are capable of contacting said liquid bath during one complete rotation of said shaft; and
   (g) a means to rotate said shaft around said axle to allow for the successive alignment of said open ends of said spokes and said openings in said axle such that said material is sequentially loaded into one of said spokes at a time, dipped into said liquid bath while contained in said spoke and unloaded from said spoke while said housing is maintained at air tight conditions.

2. The apparatus according to claim 1 which further comprises a means to heat said housing.

3. The apparatus according to claim 2 wherein said apparatus is an oil shale retorting apparatus.

4. The apparatus according to claim 1 which further comprises an auger feeder, said auger feeder disposed within said inlet conduit upstream of said opening at the bottom of said axle.

5. The apparatus of claim 1 wherein valve means communicates with said outlet conduit.

* * * * *